US009011197B2

(12) United States Patent
Smoot et al.

(10) Patent No.: US 9,011,197 B2
(45) Date of Patent: Apr. 21, 2015

(54) ROBOTIC MARIONETTES ON MAGNETICALLY-SUPPORTED AND HIGHLY MOBILE PUPPETEER PLATFORMS

(75) Inventors: Lanny S. Smoot, Thousand Oaks, CA (US); Timothy Caldwell, Boulder, CO (US); Gary W. Schnuckle, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 1399 days.

(21) Appl. No.: 12/397,990

(22) Filed: Mar. 4, 2009

(65) Prior Publication Data

US 2010/0227527 A1 Sep. 9, 2010

(51) Int. Cl.

| | |
|---|---|
| ***A63H 33/00*** | (2006.01) |
| ***A63J 19/00*** | (2006.01) |
| ***A63F 7/00*** | (2006.01) |
| ***A63F 9/34*** | (2006.01) |
| *A63F 3/00* | (2006.01) |

(52) U.S. Cl.

CPC ..... *A63F 7/0088* (2013.01); *A63F 9/34* (2013.01); *A63F 2003/00662* (2013.01); *A63J 19/00* (2013.01)

(58) Field of Classification Search

USPC ..... 446/359–362, 82–84, 133–136, 228

See application file for complete search history.

(56) References Cited

U.S. PATENT DOCUMENTS

| | | | | |
|---|---|---|---|---|
| 3,493,274 | A * | 2/1970 | Emslie et al. | 310/90.5 |
| 4,037,358 | A * | 7/1977 | Rosenbaum | 446/30 |
| 4,137,665 | A * | 2/1979 | Bierwiler | 446/83 |
| 4,171,592 | A * | 10/1979 | Saitoh | 446/456 |
| 6,132,284 | A * | 10/2000 | Lin | 446/267 |
| 6,520,830 | B1 * | 2/2003 | Vollmar et al. | 446/444 |
| 7,025,656 | B2 * | 4/2006 | Bailey | 446/444 |
| 7,192,628 | B2 * | 3/2007 | Burrows | 427/598 |
| 2008/0012865 | A1 * | 1/2008 | Forbes | 345/473 |
| 2009/0088046 | A1 * | 4/2009 | Discoe et al. | 446/465 |

* cited by examiner

*Primary Examiner* — Melba Bumgarner
*Assistant Examiner* — Amir Klayman
(74) *Attorney, Agent, or Firm* — Marsh Fischmann & Breyfogle LLP; Kent A. Lembke

(57) ABSTRACT

An apparatus for suspending and positioning marionettes. The apparatus includes a thin, planar support membrane such as a plastic sheet. A tender vehicle is positioned on the upper side of the support membrane. A motor or other drive mechanism selectively positions the tender vehicle relative to the support membrane. The apparatus includes a puppeteer vehicle from which a marionette is suspended. The puppeteer vehicle is positioned proximate to the lower side of the support membrane opposite the tender vehicle. To support the puppeteer vehicle, one or both of the vehicles includes one or more rotatable magnetic elements such that the attractive forces support the weight of the puppeteer vehicle and the marionette. Typically, the puppeteer vehicle is a passive follower, and the drive mechanism of the tender vehicle includes motors to move the magnetic elements and position the tender and following puppeteer vehicle with its marionette to provide a show.

24 Claims, 9 Drawing Sheets

ROBOTIC MARIONETTES ON MAGNETICALLY-SUPPORTED AND HIGHLY MOBILE PUPPETEER PLATFORMS

BACKGROUND OF THE INVENTION

1. Field of the Invention

The present invention relates, in general, to puppets or marionettes and, more particularly, to a robotic marionette system that utilizes magnetic forces to support puppets/marionettes in a manner that allows one or more marionettes to be used in a single show or display with full translational movement in the horizontal direction and with accurate positional control of the marionettes (e.g., accurate horizontal (X-Y) positioning as well as vertical (Z) positioning) without tangling of marionette strings or unwanted collisions.

2. Relevant Background

For many years, theme parks and other entertainment venues have provided shows and attractions that operate without human intervention or are automated portions of a show or ride. Animatronic or robotic figures may take many forms, such as a human (e.g., a pirate) or animal, and these robotic figures may be capable of various levels of life-like movement. The goal behind using animatronics is to provide a high quality and entertaining effect or show without the need for human interaction such that an effect or show can be provided in a predictable and repeatable manner. For example, animatronic figures may perform certain actions each time a ride vehicle passed a certain point along a track in an amusement park ride.

While serving many entertainments needs, the use of animatronic figures also has a number of limitations and drawbacks. Animatronic figures are generally quite heavy and require a relatively large support structure or performance platform. Animatronic figures are also relatively expensive to design, fabricate, and maintain. Animatronic figures are often hydraulically operated or actuated, and the hoses, compressors, and other actuation equipment make the figures relatively immobile. The figures typically are mounted in one position. There is a growing demand in theme parks and other entertainment venues for animatronic-like entertainment in which the characters or figures are able to more freely move around on a stage instead of being tied down to one position. In some cases, it may even be desirable for a character to be able to fly such as a fairy, a ghost, or a winged animal that may be able to walk or run and then accelerate and ascend into the air. Additionally, there is an ongoing need for these characters to be able to move freely around the stage, sometimes in close proximity to each other and/or human actors, without interference between them.

Marionettes address some of the problems with animatronic figures and meet a number of the goals for use of characters and animated figures in a ride or show. Marionettes or puppets are typically lightweight and can move around on a stage with a simulated walk or dance. Marionettes, of course, can fly when a human puppeteer takes up the weight of the puppet using its attached strings. However, use of marionettes also presents challenges and limitations. In a puppet show, it is often difficult to provide movement over a large area, e.g., marionettes often are only moved in a relatively small circular area corresponding to the puppeteer's reach. When a wider range of translational movement is provided or allowed, there are often challenges with two or more marionettes being in proximity as the strings can easily become tangled when the marionettes have to circle about each other or collide. Marionette movements are also often less realistic than animatronic figures as they can only roughly simulate walking and move too slowly in some cases, e.g., downward movements of any part of their bodies is generally limited by gravitational forces as the puppeteer cannot push downward on the attached strings.

It has also been expensive and difficult to provide a marionette-based show or display that can be provided on demand and in a predictable and repeatable manner. Human operators or puppeteers are most typically used to create a puppet show or entertainment with talented and choreographed movement of the marionettes. Use of human operators may make marionette-based shows or effects expensive, leads to each show being unique or different, which may be undesirable, and makes it problematic to present the show on an ongoing or continuous basis (e.g., whenever a ride is running it may be desirable to present flying, dancing, and interacting characters).

Some efforts have been made to suspend and animate marionettes through the use of an X-Y gantry crane and through the use of robot arms. When one puppet or marionette is used, these devices have been relatively successful at suspending the character or figure and moving it in the X-Y plane (or providing good translational movement). However, these systems or devices do not accommodate multiple interacting marionettes with each marionette having full freedom of movement in the X-Y plane. In use of such devices, the supporting arms cannot cross each other (e.g., the robot arms cannot collide or go above or under each other when a pair of characters dance around the floor or circumnavigate each other) as this results in the tangling of strings or interference between the crane/robot arms. Additionally, these devices are often expensive to implement and maintain and may provide relatively slow response times or movements.

Hence, there remains a need for improved methods for providing characters or figures that address some of the issues with robotic and animatronic figures. Preferably, the methods, and systems/devices implementing such methods, will provide figures that can move freely on a stage or in a show or effect space in all three directions (e.g., translational movement in a horizontal plane as well as vertical movement) and in relation to other figures/characters without interference (e.g., without tangling of marionette strings and the like).

SUMMARY OF THE INVENTION

The present invention addresses the above problems by providing a marionette-based show system that provides a technique of suspending marionettes that allows the marionettes to move freely about a stage in close proximity and even about each other without tangling or interference. Briefly, a tender vehicle is provided and adapted for selective positioning or translational movement on an upper surface of a ceiling or support membrane (e.g., a thin sheet of taut plastic or the like). A puppeteer vehicle is positioned near the lower surface of the ceiling opposite the tender vehicle, and the two vehicles are coupled using magnetic fields or attractive forces such that the puppeteer vehicle is suspended using magnetism. For example, both vehicles may include wheels that are formed of permanent disk magnets, and the tender vehicle may include one, two, or more servo or other motors for driving the magnetic wheels while the magnetic wheels may be mounted for free spinning in the puppeteer vehicle (e.g., such that this vehicle is passive or a follower). A marionette or other show component may be suspended from the puppeteer vehicle, and puppeteer components such as motor-driven pulleys or levers may be used to animate or move the marionette. Wireless communications may be used to remotely control the tender vehicle and selectively position it on the support membrane, which also provides full translational movement of the suspended puppeteer vehicle and marionette. Likewise, control or show signals may be transmitted to the puppeteer vehicle to remotely operate the puppeteer components such as to cause the marionette to perform a show previously stored in memory. A show system may include two, three, or more of these tender vehicle/puppeteer vehicle pairs to provide multiple marionettes that can move about a show space to provide a desirable puppet show.

More particularly, an apparatus is provided for suspending and positioning show components such as marionettes. The apparatus includes a support membrane such as a substantially planar sheet or web of non-magnetic material (e.g., a sheet of colored or transparent plastic or the like) with a thickness of less than about 0.25 inches. The apparatus also includes a tender vehicle that is positioned near or against a first side of the support membrane, and the tender vehicle includes a drive mechanism that selectively moves or positions the tender vehicle relative to the support membrane (e.g., provides translational movement in response to control signals from a remote control station). The apparatus includes a puppeteer vehicle supporting a show component (e.g., a marionette, a robot/animatronic, a light, a camera, a speaker, or the like). The puppeteer vehicle is positioned proximate to a second side of the support membrane opposite the tender vehicle.

To maintain the puppeteer vehicle near the support membrane, one or both of the vehicles includes one or more rotatable magnetic elements (e.g., rare earth permanent magnets in disc shape) providing a magnetic field. In other embodiments, both vehicles include one, two, or more of the rotatable magnetic elements that are paired such that the membrane is squeezed between each pair. The drive mechanism may include electric motors (such as servo motors) driving disc magnets or magnetic wheels, and the puppeteer vehicle may include ferrous wheels attracted to such driven disc magnets/wheels or additional disc magnets/wheels that are mounted for free spinning (e.g., such that puppeteer vehicle is a passive follower of the tender vehicle on the support membrane). The show component may be a marionette (with or without animatronic portions to animate the character) suspended from the puppeteer vehicle, and the puppeteer vehicle may include a drive mechanism such as a remote control electric motor driving a pulley upon which the marionette string is used to position or move the marionette. Wireless communication modules may be provided on one or both vehicles so as to allow remote control signals (or show commands) to be received at the vehicles and to have the vehicles operate in response to perform a show (e.g., receive previously determined/recorded position data for the tender vehicle and puppeted movements for the marionette for a particular show routine).

DETAILED DESCRIPTION OF THE PREFERRED EMBODIMENTS

Figure 1:
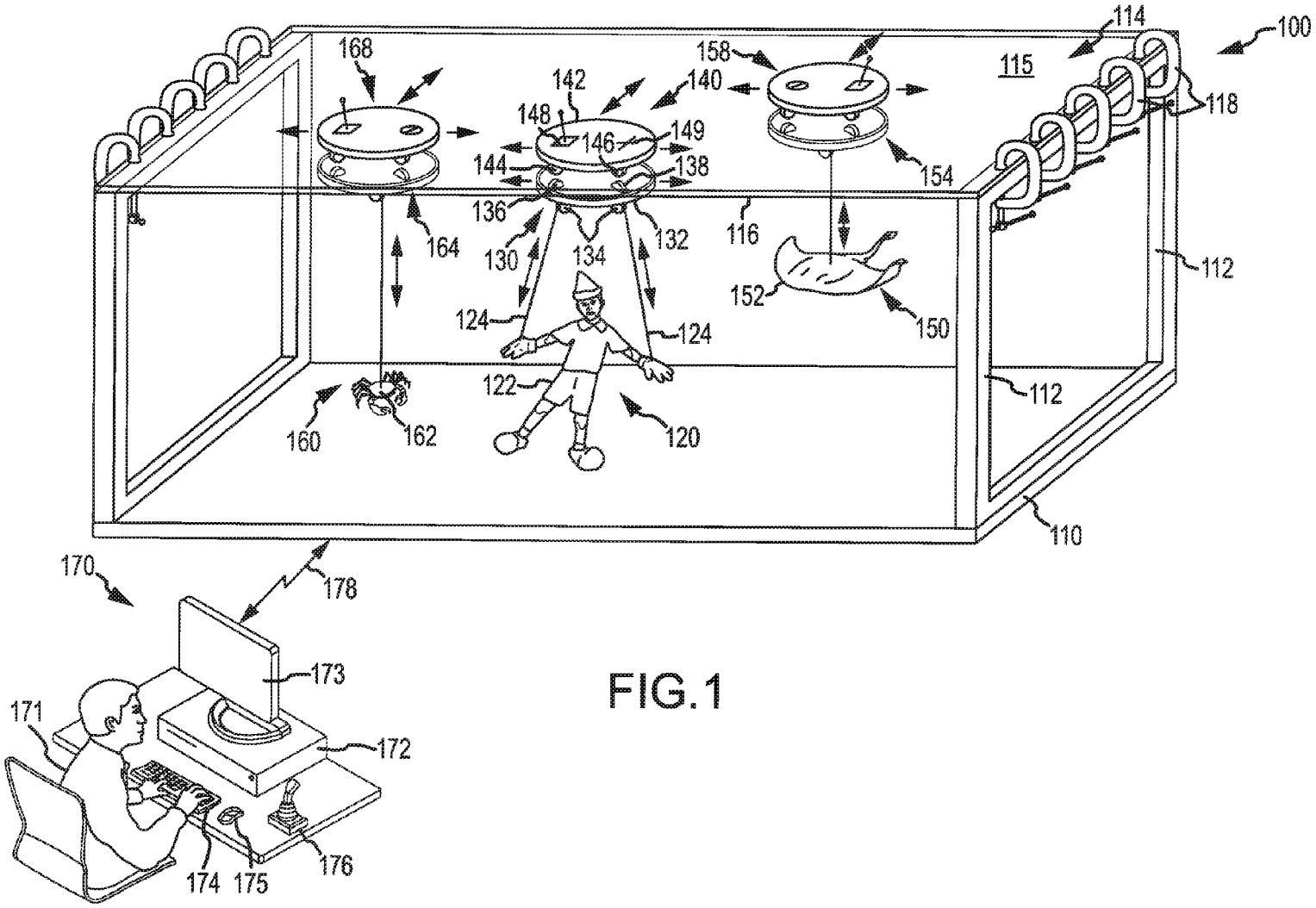
FIGS. 1 and 2 illustrate perspective views of a marionette-based show system in accordance with an embodiment of the invention using three marionette assemblies for suspending marionettes from a ceiling and selectively positioning the marionettes with a full range of translational movement as well as vertical positioning.

Briefly, embodiments of the present invention are directed to computer and/or remote controlled, robotic manipulation systems, and marionette-based show systems utilizing these systems and techniques to provide an automated or remotely controlled marionette/puppet show. The marionette-based show systems include marionette support and positioning assemblies that include a puppeteer tender (e.g., a driver vehicle) and a puppeteer assembly (e.g., a passive follower or puppeteer vehicle). The puppeteer assemblies, or simply "puppeteers," roll underneath or against a ceiling or support membrane (e.g., a thin sheet of plastic, glass, or the like). The puppeteers are kept from falling to the ground by providing a rolling analog of themselves in the form of the puppeteer tender. The puppeteer tender rides above the puppeteer vehicle and at least one of the tender or puppeteer vehicle includes one or more magnetic rollers or wheels such that the puppeteer vehicle is pulled up against or toward the membrane and the tender.

In some embodiments, the puppeteer tender includes one, two, or more wheels in the form of strong permanent magnets and also provides the motive power (e.g., with a battery-operated motor attached to the magnetic or other wheels) for both itself and the suspended, paired puppeteer vehicle (although, in some cases, the puppeteer can drive both vehicles or the motive traction can be shared). The tender may be remotely controlled (e.g., via a joystick or the like in a manual fashion or to position the puppeteer to suit a choreographed show stored in memory) to nearly any position on the ceiling (e.g., wide range of translational movement). The puppeteer vehicles/assemblies may include an array of pulleys and/or levers mounted on the vehicle body, for example, that also can be remotely controlled or operated to raise and lower portions of a puppet (e.g., a partially robotic marionette figure or animatronic character) hanging beneath the vehicle body. One puppeteer and its pulleys/levers may lift and manipulate a single marionette or multiple puppeteers may act collaboratively to suspend and/or operate a marionette (e.g., to support a larger or heavier (or both) puppet).

Typically, the show systems will include two or more marionette support and positioning assemblies, and the support or suspension techniques allow each of these assemblies and their supported marionettes to operate in close proximity and with full translational movement without interference or tangling. The marionette support and positioning assemblies provide a way to provide aspects of a conventional robotic puppet (e.g., via animatronics) combined with the mobility and even free flying ability of a marionette. One tender vehicle can circumnavigate or circle another tender vehicle such that two marionettes suspended via corresponding puppeteer vehicles/assemblies can fly, walk, dance, or move separately and in close proximity to achieve a new puppet show that would be impractical with human puppeteers. Additionally, the show systems described herein enable a puppet-type show using the magnetically suspended marionettes or puppet characters/people without the need for a human puppeteer, as the marionettes may be moved to provide a performance with movement of the puppeteer vehicle with the tender (translational motion) and movement of pulleys/levers (vertical movement of all or portions of the marionette) and may be moved in part by onboard robotics or animatronics.

FIG. 1 illustrates a marionette-based show system 100 in accordance with an embodiment of the invention. As shown, the system 100 includes a stage or platform 110 and a support structure 112 that may include sidewalls and/or a more scaffolding-like structure. Significantly, the support structure 112 is used to support a ceiling or support/suspension membrane 114. In the embodiment shown, the support membrane 114 is a relatively thin sheet or layer of material that supports the transmittal of magnetic forces or fields between a tender and a puppeteer to support the puppeteer. Typically, a tender will ride upon and contact the upper (or first) surface 115 of the support membrane and a paired or corresponding puppeteer will ride upon and contact (or be slightly spaced apart) from a lower (or second) surface 116 of the support membrane 114. One or both of the tender and puppeteer will include one or more magnets (e.g., a pivotal magnetic device such as a permanent magnet in disc or similar form that can roll with the tender and/or puppeteer) such that a magnetic force (or attractive force provided by a magnet or magnetic device such as electromagnet) supports the puppeteer and its load (e.g., a puppet or marionette and components for moving/controlling the puppet/marionette) without mechanical connections.

In one embodiment, the membrane 114 is a thin sheet of plastic (non-transparent and/or colored or transparent/translucent to allow visual devices such as cameras to view/track positions of the puppeteers and/or puppets/marionettes), and clamps or tensioning devices 118 are provided in support structure 112 to maintain the membrane 114 relatively taut (e.g., relatively little give or dip when the tender/puppeteer pairs travel over the membrane 114). In other cases, other materials are utilized such as, but not limited to, glass, ceramics, and non-magnetic materials (e.g., materials providing lower interference to magnetic fields). Often, the membrane 114 is positioned to be a horizontal plane similar to most ceilings, but this positioning is not required. The membrane 114 may be a sidewall (e.g., be vertical) with the magnetic forces acting to keep the tender and puppeteer together or proximate to each other (e.g., to keep a pair of pivotal components such as wheels or rollers nearby with the membrane 114 sandwiched therebetween). In other cases, the membrane 114 may be positioned to create a sloped or angled surface (e.g., not parallel to or normal to stage 110) to create a desired show or effect.

The marionette-based show system 100 includes, in this example, three marionette support and positioning assemblies 120, 150, 160. Each assembly 120, 150, 160 includes a puppeteer tender (e.g., a driver vehicle) 140, 158, 168 and a puppeteer assembly (e.g., a passive follower or puppeteer vehicle) 130, 154, 164, and one or more magnets is used to pull the puppeteer assemblies 130, 154, 164 upward against the surface 116 of support membrane, with it typically rolling upon the surface 116 and following the position of the puppeteer tender 140, 158, 168. The assembly 120 is shown in more detail, and it includes a marionette 122 supported by strings/tethers 124, and the marionette 122 may be a conventional puppet while other embodiments of system 100 call for the marionette 122 to have at least some animatronic or robotic functionalities (e.g., have a head that can be animated by turning and with eye and/or mouth movements). The puppeteer assembly 130 includes a vehicle body or frame 132 that supports a pair of pulleys 134, which may be operated by one or more motors (e.g., battery-powered motors) with motor controllers operable via signals 178 (e.g., wireless communication signals with the vehicle 132 including an RF, a Bluetooth, or other wireless communications receiver) from a remote control system or workstation 170 to lift and lower the puppet 122. The puppeteer vehicle 132 is passive in this embodiment in that its wheels are not powered but instead simply follow or rotate with adjacent wheels/drivers of the tender 140 due to magnetic forces. In this regard, the vehicle 132 includes at least one magnetic wheel (or rotatable magnetic component that may take shapes other than a standard wheel/disc shape) 136. To provide stability, a pair of wheels/casters 138 are included at opposite positions/ends of vehicle body 132, and these may be pivotal up to 360 degrees to enhance maneuverability of the vehicle 132. In some embodiments, the casters 138 may also be magnetic or include magnets, but this is not required to practice the invention (or the casters/wheels on the tender assembly 140 may be magnetic and the casters 138 simply a metal that is susceptible to magnetic forces).

On the opposite side 115 of the membrane 114, the assembly 120 includes a puppeteer tender 140 with a vehicle or vehicle body 142 that supports a driven magnetic wheel or roller 144 (e.g., a disc or cylindrical-shaped permanent magnet or electronic magnet). In some embodiments, two magnetic wheels 144 are provided and match in position with the passive magnetic wheels 136 of the puppeteer vehicle 132. Although not shown in FIG. 1, the vehicle 142 may house one or more motors to drive the wheels 144, with motor controller operable via signals 178 (or based on local controls) received via wireless receiver 148 from control station 170. The vehicle 142 may also include casters or wheels 146 that are fully pivotal to prevent tipping but passively follow with driving wheels 144. As shown, the vehicle 142 has a full range of translational movement on surface 115 (in this case, full horizontal or X-Y movement), and the magnetic forces that extend through the support membrane 114 cause the puppeteer vehicle 132 to be supported and to also move or roll on surface 116 with the tender assembly 140. In some embodiments, it is desirable to visually determine or verify the position of each tender, and this may be achieved by providing visual cues/markers 149 upon a surface of the tender vehicle 142 (such as the upper surface the body/lid of vehicle 142) that may be visually identified with monitoring cameras or the like (and recognition software in control station 170 for example).

As shown, an operator 171 may utilize the show control system or workstation 170 to control operations of the tender 140 as well as the puppeteer assembly 130 via wireless control signals or communications 178. The workstation 170 may take many forms to practice the invention and may include a personal computer or other computing device 172 along with a monitor 173. User input devices may include a keyboard 174, a mouse 175, and/or a joystick 176, and these input devices may be used to selectively send signals 178 to control operations of the tender 140 and/or the puppeteer assembly 130. For example, the joystick 176 may be used to both select the translational movement of the tender vehicle 142 and also to select the up/down movement of the puppet 122 via movement of pulleys/levers 134. In other embodiments, separate control signals 178 and/or I/O devices 174, 175, 176 (or a touchscreen or voice commands) are used to control the tender 140 and the puppeteer assembly 130. Also, in some cases, the control signals 178 may be transmitted based on a stored show that choreographs operation of one or both of the tender 140 and the puppeteer 130 (e.g., movement of a puppet 122 may be based on a stored show performed by a human puppeteer or the like). Typically, the workstation 170 would be positioned off stage 110 out of sight of viewers of the show provided by system 100, and this may make it desirable to provide visual monitors/cameras to determine positions of tenders 140 as shown with markers 149 or other sensors (IR sensors as discussed further below) to provide particular show effects and/or avoid having puppets 122 contacting other puppets and/or obstructions on the stage 110 (such as walls, props, human actors, and the like).

One key advantage of the show system 100 is that more than one puppet/marionette may be used in a show at a time without concern of tangling or unwanted interference between the puppets/marionettes. As shown in FIG. 1, three marionette support and positioning assemblies 120, 150, 160 are utilized to provide a show. The assembly 120 may include a more complex marionette 122 that includes two tethers/strings 124 and/or animatronic functionality. The assemblies 150, 160 may also provide complex puppets/marionettes such that two characters may dance together or otherwise interact in a show. In other cases, as shown, the assemblies 150, 160 may be used to provide background objects or characters to enhance a show and provide show features for the puppet 122 to interact with or react to in the show system 100. As shown, the assembly 150 also includes a tender 158 moving about the upper surface 115 of membrane 114. The tender 158 includes one or more pivotal or rolling magnetic components that apply an attractive force on a metallic or magnetic component in puppeteer 154 rolling upon lower surface 116 and supporting/vertically positioning puppet 152. The puppet 152 may be a relatively simple character such as a stingray as shown, a bird, or the like. A third assembly 160 is included with a marionette 162 that is supported and vertically positioned by puppeteer 164, which rolls passively on surface 116 of support membrane 114 with tender 168 (which again includes a magnetic component applying an attractive force through membrane 114 to support the tender 164 as explained in detail with reference to tender 142 and puppeteer vehicle 132).

Figure 2:
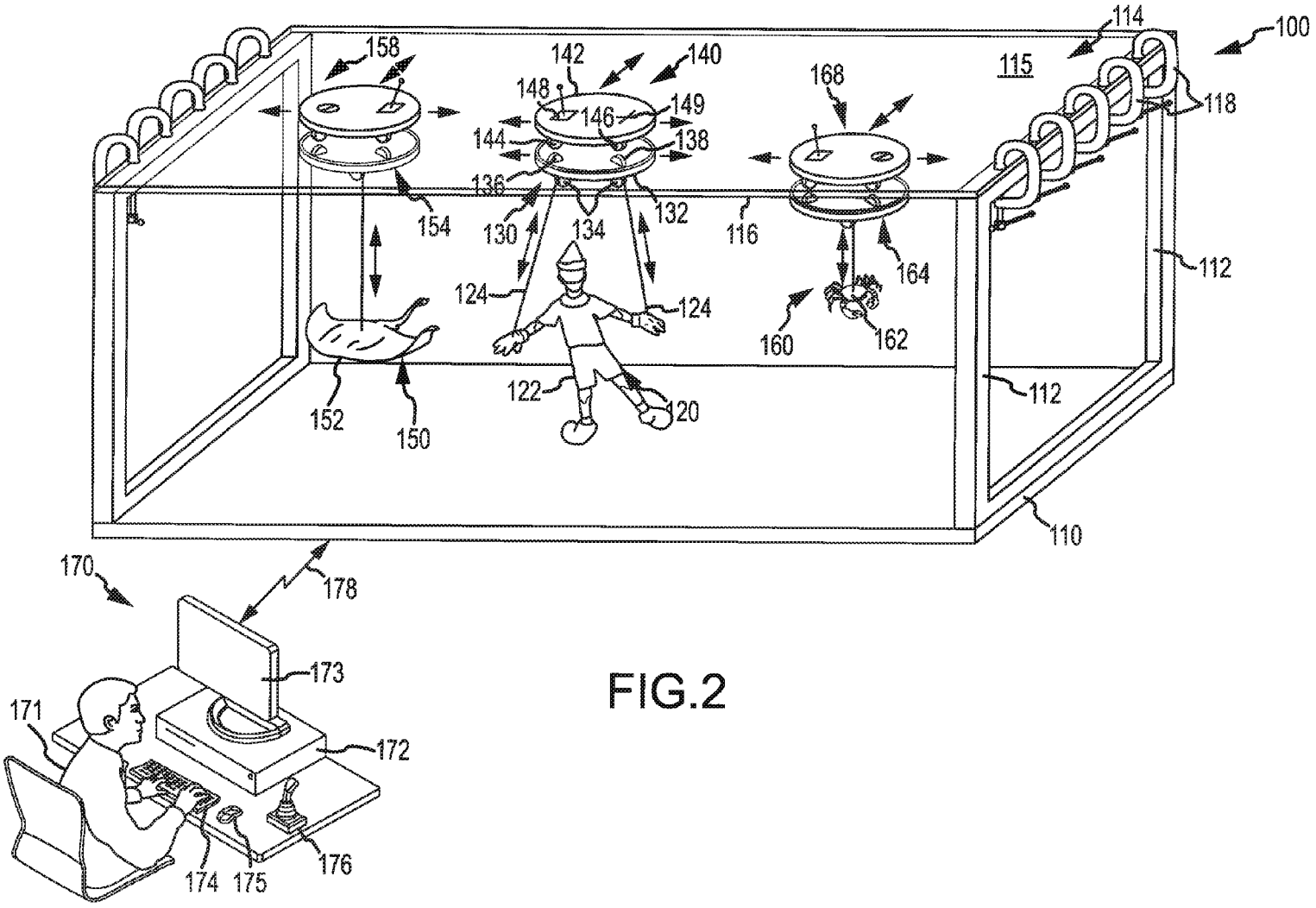

The three assemblies 120, 150, 160 may have full ranges of translational movement (in this case X-Y positioning on the horizontal plan defined by membrane 114) relative to each other. Their positioning may be automated based upon onboard intelligence/controls and/or may be controlled via signals 178 by operation of control workstation 170. FIG. 1 shows that each tender 140, 158, 168 may move independently about the surface 115, with the puppeteers 130, 154, 164 passively following on surface 116. FIG. 2 shows the show system 200 at a different time in which each assembly 120, 150, 160 has been moved and/or operated as part of a show. As shown, the assembly 120 has been operated to move the tender vehicle 142 upstage and also to pivot 180 degrees to cause the puppet 122 to have its back to the audience or to face upstage. The assembly 150 has been moved to stage right on the other side of the assembly 120, and this shows that no interference or tangling occurs between the puppets 122, 152 during such movement around each other. Further illustrating this point, the assembly 160 has moved from stage right to stage left or has at least partially circumnavigated the assembly 120 (e.g., each of the puppets 122, 152, 162 may be moved fully around each of the other puppets 122, 152, 162 without fear of tangling supporting strings).

Prior to turning to further specific examples with reference to FIGS. 3-9, it may be useful to consider a few of the more general considerations of the inventors and advantages/features of the show systems of the present invention. The show systems solve the problems associated with conventional puppet-based shows with mobile robot assemblies termed puppeteers herein that are supported or suspended under a ceiling/membrane surface and function to provide the lift and unfettered X-Y translation.

Some embodiments of show systems involved a magnetic vehicle that was suspended under a ferrous or metallic ceiling. In such embodiments, no tender vehicle was used, but, instead, a puppeteer vehicle used traction wheels or treads and was held to the ceiling via powerful magnets mounted under its chassis (e.g., on a surface proximate to the ceiling surface) where its magnets would be close to, but typically not directly in contact with the ceiling surface. These show systems may be useful in some applications but their weight would have to be supported by an electromagnetic component and/or rare earth or other permanent magnets, which are extremely strong but much of this strength would be used simply to hold up the power source of the puppeteer leaving a smaller amount of lift to support the puppet/marionette and its operational components (e.g., levers/pulleys, motors, batteries, controllers, and so on). Also, if the magnetic force were being generated by an electromagnet, the energy consumption to provide suspension (as well as the not insignificant power required to move the vehicle on the ceiling) would result in a short battery life. If the power were transmitted by wires from an off-board power supply, those power wires would create the same issues for interference/fouling as the suspension strings would for conventionally supported and operated marionettes. For these reasons, the show system 100 of FIG. 1 and other embodiments shown in the attached figures and described below are typically considered more preferred embodiments of the invention. Specifically, most embodiments of the show systems call for the puppeteer to be suspended from a second, driving vehicle termed the puppeteer tender that rides atop a thin, strong, non-magnetic suspended ceiling (or support membrane), and, thus, the puppeteer does not have to support batteries to move the puppeteer vehicle about the ceiling but instead may passively follow the puppeteer tender.

Regarding puppeteer design criteria/aspects, it was determined that it would be desirable for the puppeteer to be able to perform functions similar to human puppeteers. To this end, the puppeteer assembly may include components (e.g., pulleys, levers, animatronics/robotics on the puppet itself, and so on) and/or the tender may be designed to: (1) support a reasonable load without detaching from the tender; (2) move in any direction with a minimum of translation; (3) require a modest infrastructure that can support both large and small shows; (4) move quickly enough to satisfy entertainment artistic criteria (e.g., adequate continuous velocity with sufficient acceleration and deceleration capability); (5) allow multiple puppeteers to be operated simultaneously and independently (or collaboratively) so as to allow shows where more than one marionette or suspended object is controlled; and (6) provide the ability to be located accurately and controllably so that each marionette can effectively "hit its marks" during a show.

Regarding the first two criteria above, early in the development, it was decided that a weight limit may be placed upon the marionettes to allow smaller magnetic forces (and less powerful/smaller sized magnets) to be used to support the puppeteer assembly and to facilitate ready horizontal and vertical movements. For example, puppets or animatronic characters/objects may be suspended from the puppeteer vehicles that are less than about 20 pounds and more typically less than 10 pounds, which is useful as many large and complex marionettes intended for human puppeteers are less than this weight. Modern rare earth magnets of modest size (e.g., disk-shaped magnets less than about 1 inch such as about 0.5 inches or less and less than about 0.375 inches thick such as less than about 0.25 inches thick) can readily achieve this lift or suspension capacity, and use of two or more magnets on the tender vehicle and/or on the puppeteer vehicle can readily be used to increase lifting capacity (e.g., spread the load supported by each particular magnetic wheel/rotatable magnetic support element).

Regarding the tender and puppeteer vehicles, some embodiments may use a holonomic vehicle, which may be useful particularly for the puppeteer vehicle. In other embodiments, the vehicles may be relatively simple two-wheeled vehicles (e.g., with a differential drive platform or the like). Although the differential platform may not be able to move in all directions without turning, its simple design makes up for this deficiency. Further, the "turn without moving" holonomic capability may be regained somewhat in some embodiments through the use of a rotating suspension platter on the puppeteer vehicle for supporting the marionette. In such embodiments, the suspended marionette may face in one direction while moving in another (e.g., to mimic a person turning to look over their shoulder as they move forward or to jump in one direction and spin to simulate a dance move). In other words, the marionette's support base on the puppeteer vehicle may be pivotally mounted to move about its central axis while the vehicle is following the tender vehicle on the ceiling surface.

In some vehicle designs, it was determined that suspension, traction drive, as well as turning, could be accomplished by making the wheels of the vehicle from disk magnets (e.g., see FIG. 3 below at elements 332, 333). In addition, using these magnets in mirror image positions on the puppeteer vehicle (as shown in FIG. 4 at 420), with one vehicle on one side and the other vehicle on the other side of a thin support membrane (e.g., a ceiling, a sidewall, and so on) leads to several advantages. Significantly, a requirement for absolute rigidity or even planarity of the support membrane, such as a ceiling of a stage area, is removed. The wheels of the puppeteer vehicle are magnetically compelled or forced to line up directly below or adjacent and directionally aligned with the wheels of the puppeteer tender vehicle, and the paired wheels of the two vehicles "squeeze" or apply counter, compressive forces on the material of the ceiling or support membrane between them. Thus, steering motions of the tender vehicle are instantly and passively followed by the puppeteer vehicle wheels.

In order to keep the suspended, two-wheeled puppeteer vehicles from tipping around the axis of the drive wheels, at least a third wheel or pivotal support is provided on the puppeteer vehicle (and typically the tender vehicle, too). For example, a third wheel or caster may be provided in a tripod configuration on the puppeteer vehicle chassis and/or the tender vehicle chassis. The wheel preferably is an omniwheel or a caster to pivot 360 degrees to facilitate movement in any direction on the contact surface. Since the puppeteer vehicle may be supporting a swinging load that may cause the vehicle to tip even more, some embodiments make the vehicle symmetrical by providing two or more support legs with casters (e.g., one caster mounted on the front and one on the back of the vehicle). These casters may be kept in direction synchronization automatically since the tender casters tend to rotate to accommodate the direction of movement of the tender vehicle and the puppeteer casters swivel to match the tender vehicle's wheels orientation as the puppeteer vehicle follows the movement of the tender vehicle due to the applied magnetic fields.

A variety of materials and thicknesses may be used for the support membrane. In one embodiment, though, the membrane is provided with a stretched plastic sheet, as this is a readily available material that is inexpensive and can be transparent to allow visual monitoring of the positions/operations of the puppeteer vehicles and/or puppets. Large, low cost "ceilings" or support membranes can easily be fabricated using stretched plastic web material. The sheet may be thin such as a 30 mil thick sheet that may support several puppeteer assemblies including 10-pound marionettes, with one tested embodiment providing a worst case dip of about 2 inches even when stretched over a large area or stage (e.g., over a 12-foot by 20-foot area). The thin web or support membrane provides short magnetic flux paths (which allows less powerful magnetic wheels to be used or heavier loads to be carried/supported) and also provides a lightweight ceiling such that the ceiling support structure may be reduced or minimized.

Several prototypes were fabricated to test the overall concept. In some of these prototypes, the drive motors for the magnetic drive wheels were mounted within the tender vehicle. In one prototype, hobby model servo motors (or "servos") were used to drive two magnetic traction wheels. This provided extremely high torques to the wheels, but, in some cases, it was desired to provide higher velocities to support particular shows and/or create quicker show effects. Hence, in some embodiments, the drive motors were continuous rotation gear motors fabricated by modifying conventional, limited-rotation, hobby servos (e.g., disabling the internal feedback potentiometers, and removing hard stops that prevent continuous rotation). This resulted in extremely high torque wheel motors, but the servos were not useful for providing feedback on the position (rotation or translation) of the vehicle. These earlier embodiments/prototypes were programmed or controlled using dead reckoning and were not as good at providing accurately reproducible shows and show trajectories/positioning. In addition, some movements were relatively slow because of the high step-down gear ratios in the hobby servo gear trains.

Other prototypes used industrial servo motors, with each motor having a built-in shaft encoder. Greater speed may be obtained in some cases by using larger wheels on one or both of the vehicles. For example, larger wheels may be used on the tender vehicle while using smaller wheels on the puppeteer vehicle, with one or both being magnetic such as using disk magnets as the drive wheel on the tender vehicle while using non-magnetic but ferrous wheels for the puppeteer vehicle or vice versa. The use of magnetic wheels on only one vehicle typically will reduce the lift or support capacity some amount (or require a stronger magnet on the vehicle using such wheels).

To provide a show, the show system includes components for controlling operation and movement of the tender vehicle and the puppeteering assembly. In one embodiment, the control software was provided on the show control system (e.g., system or station 170 in FIG. 1), and it may be programmed in Matlab (distributed by The MathWorks, Inc.) or other useful programming platform/language for controlling X-Y positioning on a plane and also Z positioning of the puppet/marionette. A wireless communication protocol such as Bluetooth RF protocol or the like may be adopted as a method for communicating between the control system or workstation and the tender vehicle and puppeteering assembly. An intuitive human interface or graphical user interface (GUI) may be used for operation of the marionette or puppet such as an X rotary mouse or a joystick with two or three directions of motion control/input. Such I/O devices may allow single-handed control of the puppeteer assembly and/or the tender vehicle. For example, pushing the control or I/O in any direction may be programmed to cause the tender vehicle and following puppeteer vehicle to move in that direction (or a corresponding direction) while rotating the knob or other I/O may cause the tender vehicle to rotate in place (or cause a rotatable plate on the puppeteer vehicle to rotate the marionette) and while providing an up or down input may cause the marionette (or portions thereof) to be raised or lowered by operation of pulleys or levers on the puppeteer vehicle. In some embodiments, shows may be choreographed and movements of the tender vehicle and/or puppeteer assembly to move the puppet may be stored in memory. Playback of a show would include retrieving such control signals from memory and transmitting them in a wireless manner to the tender vehicle and/or puppeteering assembly (e.g., recordings of human puppeteers operating the suspended marionette or puppet character). The motions of multiple marionettes and their associated tender vehicles can be manually controlled or remotely/locally controlled by stored commands/operations, and selectively reconstructed.

In some applications, it may be useful to track the position of the tender vehicle and/or the marionette/puppet. For example, shaft encoded motors may provide feedback to the control system or workstation to allow local/relative knowledge of the tender vehicle's location (such as when a starting position was known and movement from that position was determined by movement of the motor shafts attached to the driving wheels) and/or vertical position of the marionette. However, in some cases, it is desirable to know the absolute position to better insure overall show repeatability, to allow coordination of the puppeteers and supported marionettes in collaborative activities, and to allow the marionettes to know the location of humans such as actors in proximity on stage and to interact with these located humans/actors. To this end, one embodiment tracks the various tender/puppeteer vehicle pairs from above by looking downward with a monitor or camera, e.g., onto a marking indicative of a particular tender vehicle, and/or through the support membrane to the puppeteer assembly and the suspended puppet/animatronic character. This solution allows a central control process to not only observe the absolute position of the centroid of the puppeteer tender vehicle (and its state of rotation based on the location of the marker for example), but it can also see the rotational state of the marionette rotation platform onboard the puppeteer vehicle. The visual control aspect of the servo control system makes it possible to have a marionette move up close to a person on stage, talk to them, and even have a tactile interface or interaction with them (e.g., a live actor or participant from the audience could stroke the head of a marionette dog). The overhead monitor/camera may sense the position of the dog/marionette and the human or their hand and act appropriately (e.g., have the dog/marionette respond and then back up a respectable distance or have the marionette stay a close distance away and avoid being caught or touched by the actor/participant).

In one prototyped embodiment, it was desired to provide a simple control model for a fairly simple marionette. The embodiment was prototyped to verify that multiple puppeteer/tender pairs could perform simultaneously and that they could react to the presence of a human actor/participant in their midst or in the show space (e.g., on/above the stage). For example, the marionette may be an oversized butterfly or stingray, as its movements can be relatively simple yet convey a sense of reality or desired effects if properly controlled and moved with translational (X-Y) motion and vertical (Z) motion. The animation required was straightforward requiring only wing flapping movements and smooth overall translation provided by the puppeteer vehicle passively following the tender vehicle combined with up and down movement via a single control string attached to a pulley on the puppeteer vehicle. To add character/animatronic functionality, moving or robotic eyes were added to the head of the marionette character to allow it to emote with various "looks" depending upon questions posed to the butterfly marionette by an onstage human host/actor in the show space. Of course, it may also be desirable to provide a moving mouth in a character to allow it to speak to and/or lip synch an audio output. To offset this central character, another flying character was employed in the form of a cartoon-like bottle fly marionette supported on a second puppeteer tender vehicle, which was magnetically supported by a second tender vehicle. The show includes the tender vehicles and puppeteer assemblies being operated/controlled to move the two marionettes in close proximity without tangling or interference between strings or supports. The two marionette support and positioning assemblies also allowed interfacing with humans in marionette or show space and the marionette characters were able to act collaboratively (e.g., to interact with each other and/or with human actors/participants). In this embodiment, the animatronic functions such as moving or expressive eyes were recorded eye positions/movements that were keyed by the show control computer or by a backstage human operator/puppeteer.

Figure 3:
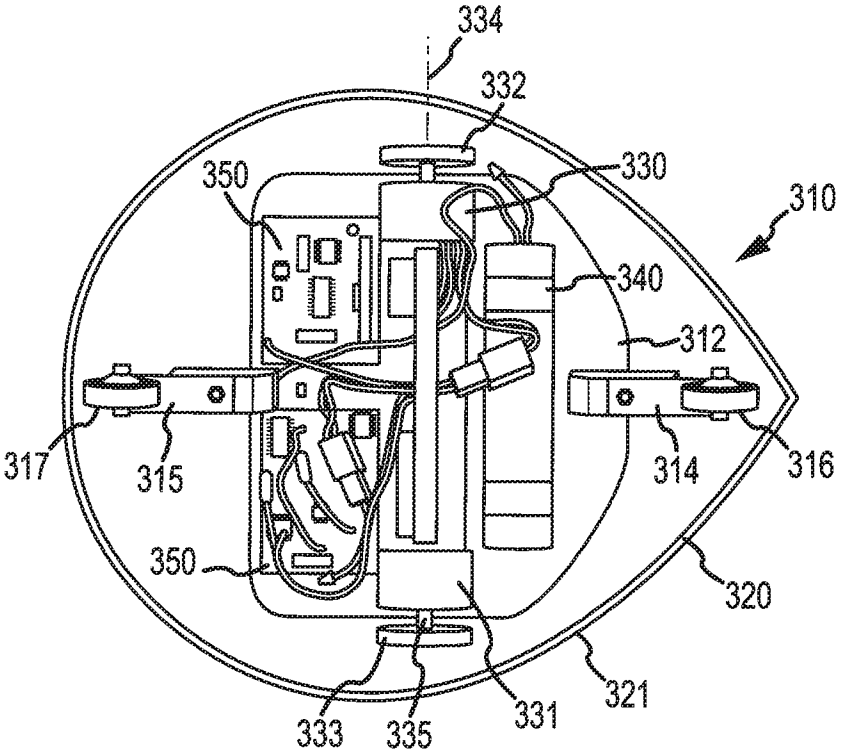
FIG. 3 illustrates a view of a puppeteer tender (or tender assembly, driver vehicle, or the like) with a top cover/lid removed showing components of the tender including motor-driven magnetic wheels and pivotal wheels (e.g., ball or wheel castors or the like)
Figure 4:
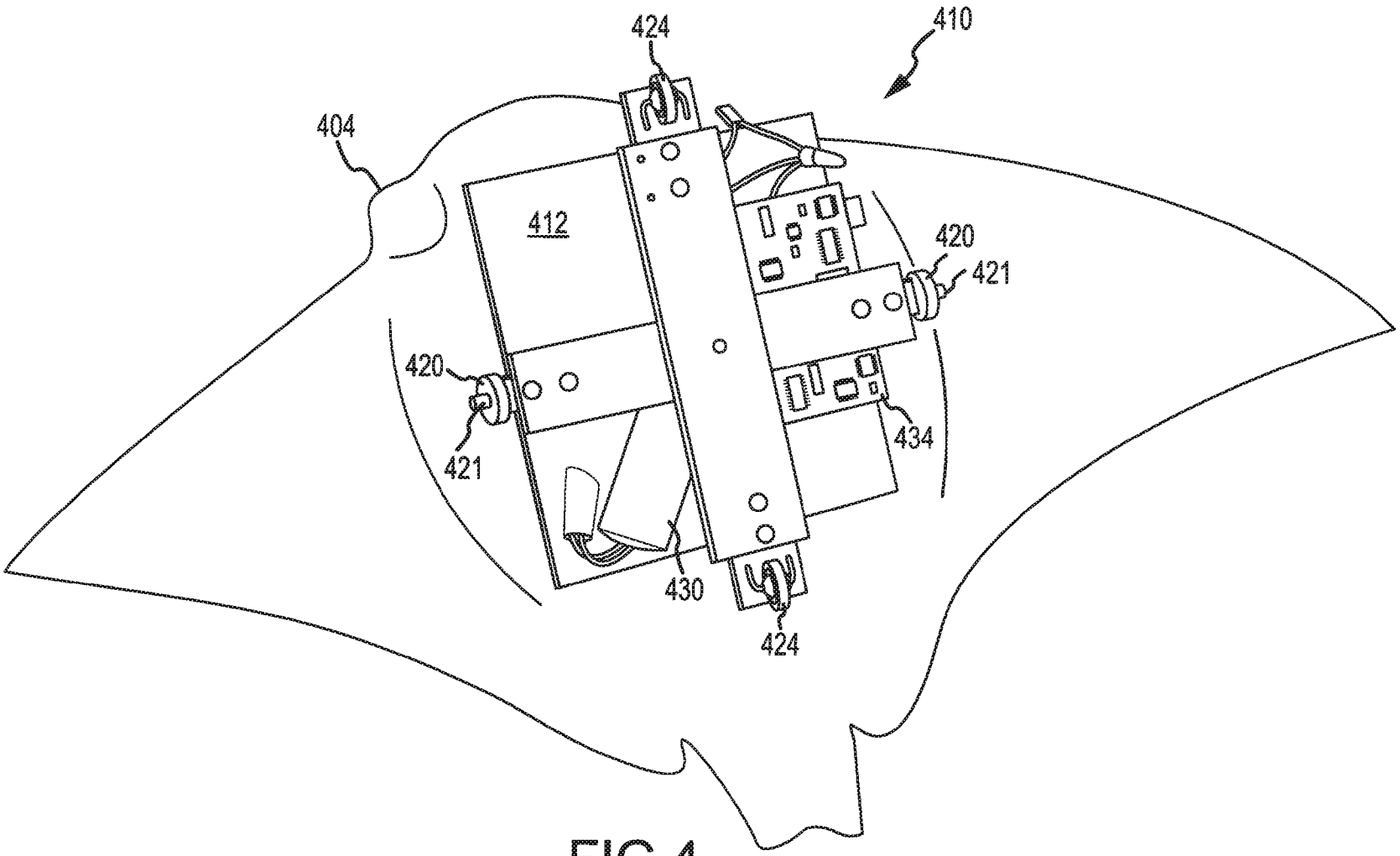
FIGS. 4 and 5 illustrate top and bottom views, respectively, of a puppeteer (or puppeteer vehicle, puppeteer assembly, driven vehicle, or the like) showing passive or driven magnetic wheels and pivotal wheels (or casters) that mirror or correspond to those of the puppeteer tender of FIG. 3 and showing a motor-driven pulley used to operate a marionette or puppet.

Referring again to the figures, FIG. 3 illustrates a view of a puppeteer tender or tender vehicle 310 with a lid or cover removed to show internal components (e.g., as may be viewed from above when the tender vehicle 310 is positioned upon a support membrane). As shown in FIG. 1, the cover/lid may be used to support a visual marker/label that uniquely identifies the tender vehicle (and its paired or corresponding puppeteer vehicle) and the orientation or rotation of the vehicle 310 about its central axis. The cover/lid may also support the wireless communication module (e.g., a RF, Bluetooth, or other antenna or the like) or this may be provided within the vehicle 310. The tender vehicle 310 includes a sidewall or housing 320 that may be used to support and mate with a lid/cover, and the sidewall 320 extends about the outer periphery of the vehicle 310 and may be attached to a chassis or base plate 312 via caster or tripod support arms 314, 315 extending outward from the base plate/chassis 312. In some embodiments, it is desirable for the outer surface 321 to be highly reflective of light or of infrared (IR) light to facilitate sending the position of the tender vehicle 310 via a transparent ceiling/ support membrane and use of IR sensors positioned in the show area/space or elsewhere below the ceiling/support membrane.

A pair of casters 316, 317 is attached via arms 314, 315 to the chassis 312 to reduce the risk of the vehicle 310 tipping and also to allow the vehicle 310 to turn in any direction (e.g., the casters 316, 317 are balls or wheels able to rotate 360 degrees about their mount to the arm 314, 315). A pair of electric motors 330, 331 (e.g., servo motors) is provided to drive a pair of drive wheels 332, 333 attached to the motors 330, 331 via axles/pins 334, 335. The motors 330, 331, may be powered by battery 340 mounted on chassis 312, and motor controllers 350 are provided to control operation of the motors 330, 331 (e.g., in response to control signals via a remote show control workstation or based on onboard logic such as to provide random motion and/or to provide motion that includes moving in a direction until an obstacle is detected such as another tender or an obstacle for the marionette supported below the tender vehicle such as via IR sensors directed at an angle downward through the support membrane or other methods of obstacle detection). The drive wheels 332, 333 in this embodiment are disc magnets, such as rare earth permanent magnets with a diameter of up to 1 inch or more and a thickness up to 0.375 inches or more, but other embodiments may use other magnetic elements, shapes, and more or fewer numbers of drive wheels (and in some embodiments the drive wheels and the magnetic support members are separate components (e.g., see FIG. 7).

Figure 5:
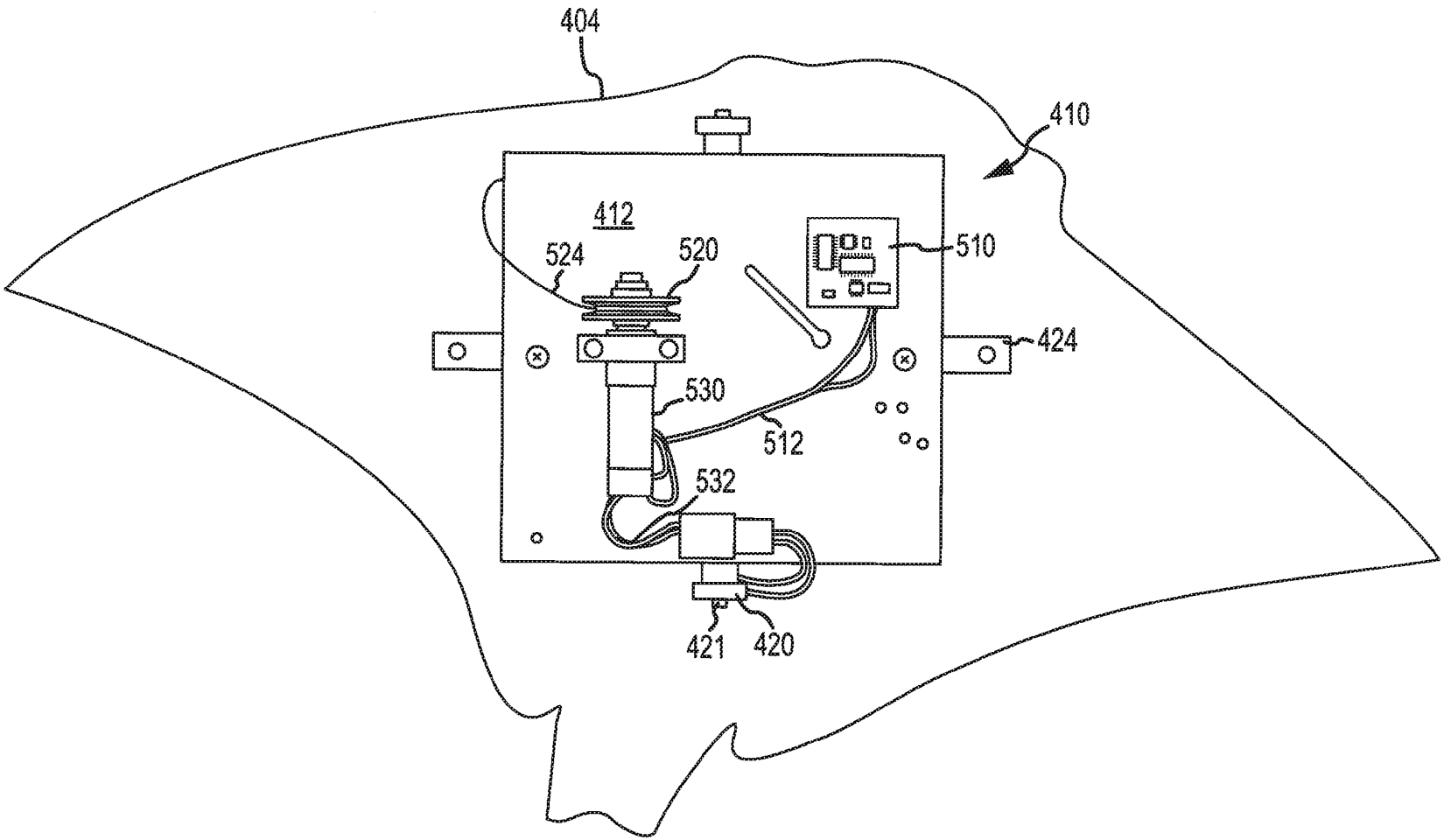

FIGS. 4 and 5 illustrate a puppeteer vehicle 410 that may be used to support and operate a marionette 404 and that may be paired with the tender vehicle 310 (e.g., to provide a marionette support and positioning assembly). The marionette 404 in this example is a relatively simple character or figure in the form of a stingray supported by a single string or tether 524, and vertical positioning and movement of the marionette 404 is provided by operation of a pulley 520 via battery-operated motor (e.g., an industrial servo motor or the like) 530. The motor 530 is connected via control/communication lines 532 with a motor controller 434. Wireless communication module 510 is mounted on chassis or vehicle body 412 and allows control signals for the motor 530 to be provided via remote show control station or system (e.g., via Bluetooth communications or other protocols), with wiring 512 connecting the module 510 with motor controller 434 (also mounted to chassis 412). A power source 430 is provided on the chassis 412 in the form of a battery that is used to power the motor 530.

In this embodiment, the puppeteer assembly/vehicle 410 is passive with regard to translational motion (e.g., X-Y motion in a plane). The puppeteer vehicle 410 includes a pair of wheels 420 that may be formed of a ferrous material such that they can be attracted to and supported by magnetic fields when placed in proximity with a pair of magnetic elements such as the drive wheels 332, 333 of the tender vehicle 310. In other cases, as shown, the wheels 420 are also formed of disc magnets to increase the magnitude of the attractive forces between the wheels 332, 333 and wheels 420 to better support the vehicle 410 and marionette 404 on a support membrane (not shown) sandwiched between the vehicles 310, 410. The magnetic wheels 420 are pivotally mounted upon chassis 412 for free wheeling and passively rotate with (or are driven by) movement of the paired or corresponding wheels 332, 333 during use of the vehicle 310. To provide stability, the puppeteer vehicle 410 includes a pair of casters 424 that may pivot or spin 360 degrees about their mounting point or axle. The casters 424 are non-magnetic in some embodiments while some embodiments call for these wheels/casters to also be magnetic components (e.g., to further distribute the support load of the tender vehicle 410 and marionette 404 weight over more magnet couples (e.g., 4 couples versus 2 couples in this example)).

Figure 6:
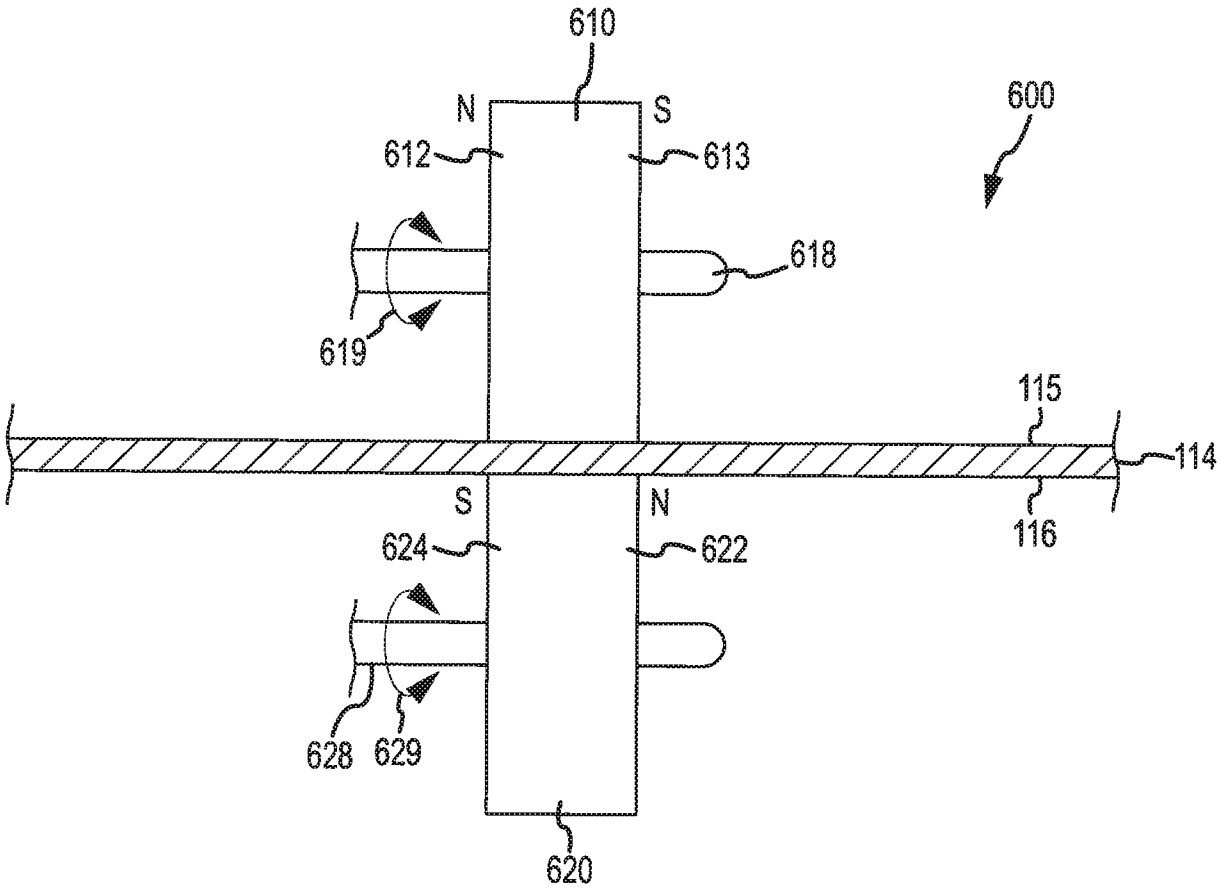
FIG. 6 is a partial view of a tender and a puppeteer illustrating use of magnetic wheels in both vehicles/assemblies to suspend or support the puppeteer on the ceiling or support membrane and to cause the puppeteer to follow or mirror the position of the tender on the support membrane or ceiling.

FIG. 6 illustrates in more detail a magnetic coupling or magnetic-based support 600 provided in accordance with some embodiments of the invention. For example, some of the marionette support and positioning assemblies include vehicles in which both vehicles include at least one pivotal magnetic member, such as a motor-driven, magnetic wheel/disc on one of the tender vehicle or puppeteer vehicle and a follower magnetic wheel/disc on the other one of the tender vehicle or puppeteer vehicle. In other embodiments, such as that shown in FIG. 7, other wheels are driven by a motor with the magnetic wheels/discs (or other rotatable members) only providing the magnetic coupling of the two vehicles to support the puppeteer vehicle on the support membrane 114.

As shown, a support membrane 114 such as a thin sheet or web of plastic or the like is provided for use in supporting a puppeteer assembly. On the puppeteer side, a vehicle wheel 620 is positioned proximate to or in contact with membrane surface 116. The wheel 620 is shown to be mounted (e.g., to a vehicle chassis not shown in this example) via axle or pin 628 for free rotation about its axis as shown at 629. The wheel 620 may be a permanent magnet that includes a north pole 622 and a south pole 624 such as a rare earth permanent magnet in disc form. Paired with the wheel 620 on the tender side, a vehicle wheel 610 is shown to be mounted (e.g., to a vehicle chassis not shown in this example) via axle or pin 619 for rotation 619 about its axis, and, typically, the axle or pin 619 is selectively rotated 619 by a servo motor or other drive mechanism such that the wheel 610 is the driver while the wheel 620 is the passive follower in this magnetic couple 600. The wheel 610 is shown with an edge against surface 115 of support membrane opposite an edge of puppeteer vehicle wheel 620. The wheel 610 may also take the form of a disc magnet (e.g., the same size as wheel 620 or a smaller or larger magnet may be used for wheel 610). The wheel 610 is arranged with its poles opposite that of wheel 620, with its north pole 612 paired or opposite the south pole 624 of the wheel 620 and south pole 613 paired or opposite the north pole 622 of the wheel 620. In operation, magnetic fields or forces pass across/through the membrane 114 (e.g., membrane 114 is non-magnetic and non-ferrous or metallic to limit interference with the magnetic interaction of wheels 610, 620) such that the membrane 114 is pinched between the wheels 610, 620 and the wheel 620 and a vehicle/marionette attached to the wheel 620 are supported by this magnetic coupling 600. Also, to cause the wheel 620 to move or spin 629, the wheel 610 is rotated 619 via axle 618 and the two wheels 610, 620 attempt to the connection, e.g., wheel 620 moves 629 with wheel 610 which causes an attached vehicle to also follow or mirror a vehicle attached to wheel 610.

Figure 7:
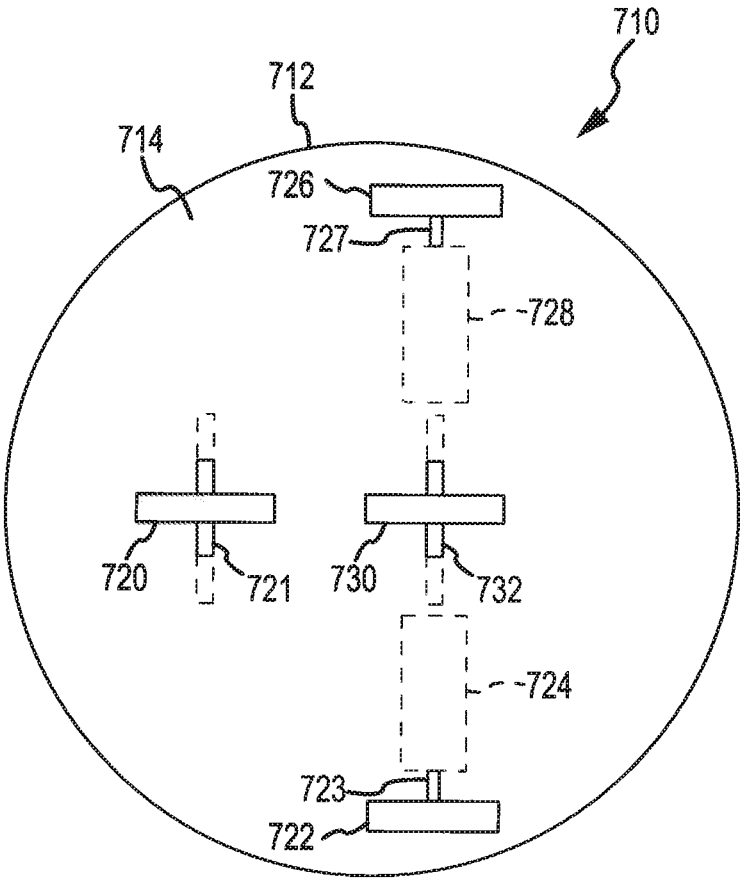
FIG. 7 illustrates a view of the bottom (or support membrane mating) portion of another embodiment of a tender vehicle or assembly in accordance with the invention.

In the above examples, the drive or driven wheels were generally shown to be or include the rotatable magnetic elements. However, this is not required to practice the invention. In some embodiments, only one of the two vehicles will include rotatable magnetic elements that are paired with metallic or ferrous material, rotatable elements in the other vehicle, and the non-magnetic elements (e.g., wheels) may be driven to provide the translation motive force for the marionette support and positioning assembly. In other embodiments, as shown in FIG. 7, the magnetic coupling may be separate from the driver portion altogether. FIG. 7 illustrates a vehicle 710 that may be used for the puppeteer vehicle or more typically for the tender vehicle, and it may operate independently with the ceiling or support being metallic or be paired with a follower vehicle (e.g., a vehicle such as a puppeteer vehicle without a drive or translational motion motor).

The vehicle 710 has a body 712 with a chassis or base 714 shown in FIG. 7. The vehicle 710 includes three wheels 720, 722, 726 with wheels 722 and 726 providing stability and translational movement of the vehicle 710 and wheel 720 typically only providing some stability with limited load bearing. Specifically, in this non-limiting implementation, the front wheel 720 is supported on chassis 714 on axle/pin 721 to be freewheeling or a follower/passive wheel. The side wheels 722, 726 are the drive wheels in the vehicle 710 and are pivotally attached via axles/pins 723, 727 to drive mechanisms 724, 728 (e.g., electric motors powered by a battery (not shown)). To provide magnetic coupling with another vehicle (e.g., a puppeteer vehicle configured similar to vehicle 710 and provided below a support membrane), the vehicle 710 includes a magnetic element or wheel 730 that is pivotally mounted to the chassis 714 via axle/pin 732, which may be aligned with axles 723, 727 in some cases (as shown). The magnetic element 730 is not directly driven but instead simply rolls with movement of the vehicle 710 in response to contact with a surface such as a side of support membrane. Again, the magnetic element 730 may be a disc magnet (e.g., a permanent rare earth magnet, an electromagnet, or the like), and a paired vehicle would include either a pivotal magnetic element or a ferrous/metallic pivotal element such that the combination results in one of the paired vehicles being supported on a support membrane. The vehicle 710 demonstrates that the number and location (e.g., in the center of the vehicle and/or on opposite or opposing sides/positions for example) of the magnetic elements can be widely varied to practice the invention, with typical vehicles including 1 to 4 or more magnetic elements (or ferrous/metallic elements for coupling with such magnetic elements).

Figure 8:
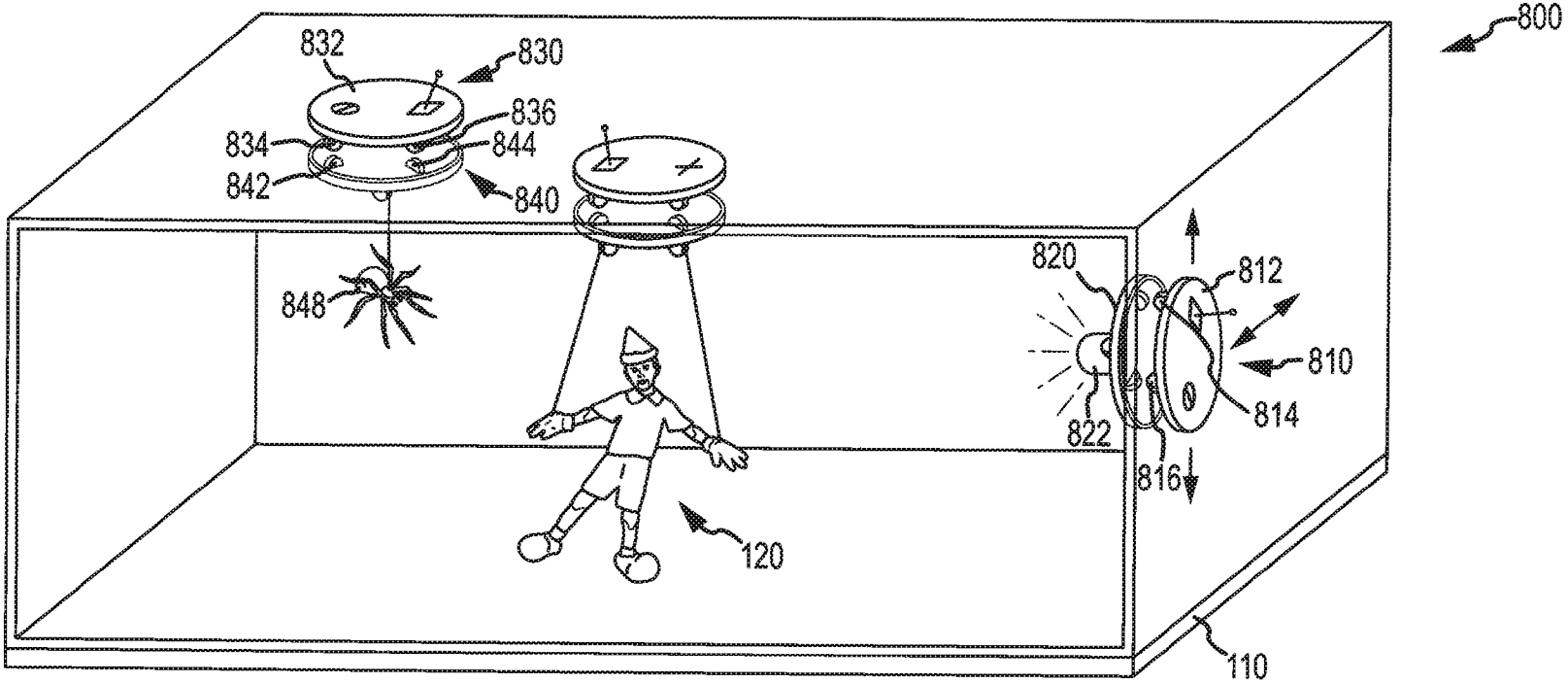
FIG. 8 illustrates another embodiment of a marionette-based show system in accordance with the embodiment showing that the support and positioning devices/techniques described herein may be used on surfaces or components other than a ceiling (e.g. a wall or the floor) and that the driver and follower (or driven) vehicles may be used to position other objects (e.g., animatronics or non-puppet objects/characters or show components such as lights, cameras, speakers, and so on)

FIG. 8 illustrates another embodiment of a marionette-based show system 800 of the invention. The system 800 is similar to that shown in FIG. 1 with like features being labeled with like numbers including the marionette support and positioning assembly 120. System 800 differs, though, as it includes a marionette support and positioning assembly 810 that is mounted on or travels upon a sidewall, e.g., an additional support membrane stretched or positioned (if rigid such as a glass wall), of the system 800. The assembly 810 includes a tender vehicle 812 with magnetic wheels/elements 814 that are driven by motors in vehicle 812 to move the assembly 810 on sidewall (e.g., to provide translational movement and positioning). Casters or pivotal supports 816 are also provided to limit tipping and stabilize the vehicle 812. On the other side of the support membrane, the assembly 810 includes a puppeteer or follower vehicle 820, which would be configured similar to vehicle 812 with ferrous or magnetic, rotatable wheels/elements paired with or coupling with wheels 814 of the tender vehicle 812 and, typically, including one or more casters to stabilize the vehicle 820. In this embodiment, the vehicle 820 is used to support a show component 822 that is not a marionette (but may be in some embodiments). As shown, the show component 822 is show light(s) that are used to illuminate the character 122 (or other portions of the show space of system 800). In other embodiments, the show component 822 may include a camera, a speaker, or other show components. The assembly 810 is useful for showing that the support membrane does not have to be a ceiling type support or be arranged horizontally but instead may be vertical or at an angle. In other embodiments, a marionette support and positioning assembly such as assembly 810 may be located on nearly any surface of a show system 800 that includes a support membrane.

The system 800 also includes another marionette support and positioning assembly 830. The assembly 830 includes a tender vehicle 832 with one or more magnetic drive wheels 834 along with casters 836, and the vehicle 832 may be operated remotely as taught for vehicle 142 in FIG. 1 or may be more automated (e.g., move randomly, move to avoid objects such as via IR sensing or other object-detection mechanisms, move based on a locally stored pattern/trajectory, and so on). The assembly 830 also includes a puppeteer or follower vehicle 840 with a rotatable mechanical wheel(s) 842 for coupling with drive wheels 834 and with casters 844 for stability. The vehicle 840 includes a supported object 848 in the form of an animatronic character or object, with an animatronic spider shown in the example of FIG. 8. In operation, the object 848 may use its robotic aspects to provide movement, to show glowing eyes, to make noise, and so on, and in this embodiment, the vehicle 840 can be simplified from other puppeteer vehicles in that it does not need to include puppeteer components to raise/lower or otherwise operate a marionette (but it may include a plate or "lid" that can be selectively rotated or moved to add movement to the object 848). Again, due to the unique support technique for marionette 122, the assembly 830 may move in close proximity to the assembly 120 and marionette 122 even to the point where it circumnavigates the assembly 120 with no concern regarding tangling of marionette strings or other interference with operation of the assembly 120 or assembly 830.

Figure 9:
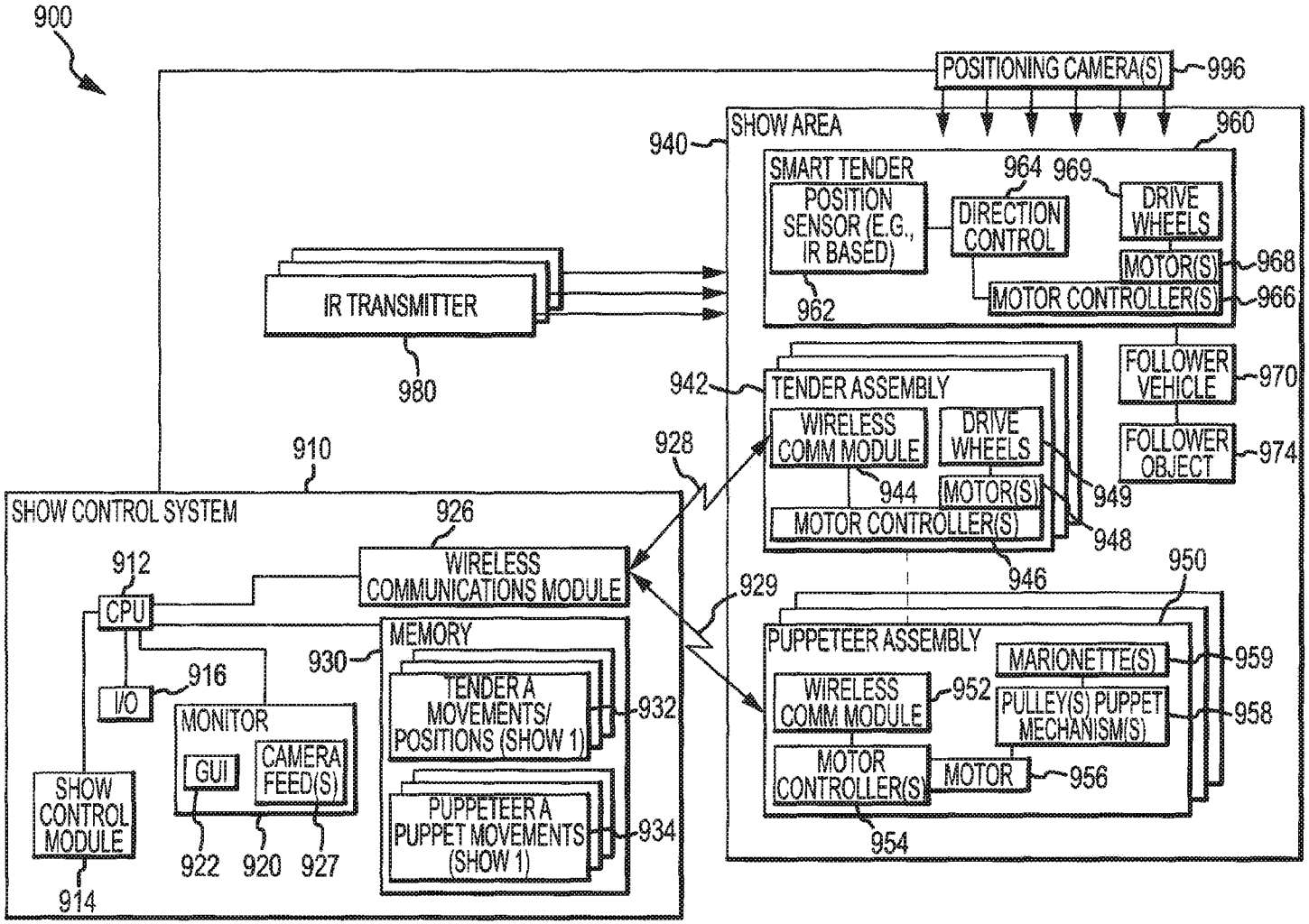
FIG. 9 is a functional block diagram of a marionette-based show system in accordance with an embodiment of the invention (e.g., as may be used to implement the system of FIG. 1).

FIG. 9 illustrates a functional block diagram of a show system 900 in accordance with an embodiment of the invention. The system 900 may be used to implement the systems 100 and 800 of FIGS. 1 and 8, respectively, and/or to operate the vehicles shown in FIGS. 2-7. The system 900 includes a show control system 910 that may be operated by an operator or "puppeteer" to remotely activate and/or control tenders and puppeteer assemblies to create a show. The control system 910 includes a processor or hardware/firmware/software components 912 that run and/or manage operation of the system 910 including running a show control module 914. The show control module 914 may include the software application(s)/routines useful for providing the show including generating a GUI 922 on monitor 920 and monitoring/determining locations of each or a subset of the tenders and/or operating marionettes. The control system 910 also includes one or more I/O devices 916 such as a keyboard, a touchscreen, a mouse, a joystick, and the like that allows the operator to control the tenders and puppeteer assemblies including initiating a show sequence or manually positioning the tender or marionette. A wireless communication module 926 is included to allow the system 910 to wirelessly communicate with the tenders and puppeteer assemblies to control their operations including, in some cases, transmitting control signals of stored shows or scripted movements.

To this end, the CPU 912 may manage memory 930 of the system 910 (or accessible by the system 910 but provided in a different location/device such as in data storage accessible via a network or the like), and the memory 930 may store movements/positions for each tender for one or more shows as shown at 932 and movements/positions for each marionette operated by the puppeteer assemblies of system 900. This show control data may include puppeteer movements/actions of a human puppeteer performing a show with a marionette 959 of system 900, and the show control data 932, 934 may be transmitted via signals 928, 929 by wireless communications module 926 via operation of the show control module 914 (automated transmittal of signals 928, 929 and/or manual initiation by a human operator of system 910 providing control via I/O 916).

The show system 900 also includes a show area 940 that may include a stage defined by sidewalls, scenery, props, and so on and that typically includes one or more support membranes (e.g., thin sheets of taut plastic, panes of glass, and so on). In the show area, one or more tender assemblies 942 are provided that include wireless communication modules 944 to communicate via signals 928 with control system 910. The tender assemblies 942 also include motor controllers 946 for operating one or more electric motors (e.g., industrial or other servo motors or the like) 948, which drive or turn drive wheels 949. As discussed above, the drive wheels 949 may include or be formed of magnetic elements such as disc-shaped magnets. Each of the tender assemblies 942 is paired with a puppeteer assembly 950, with a magnetic element or wheel (or ferrous/metallic element) of the puppeteer assembly 950 coupled with the magnetic elements of the tender assemblies 942 to support the puppeteer assemblies 950 upon a support membrane. The puppeteer assemblies 950 may also include wireless communication modules 952 for communicating via wireless signals 929 with show control system 910. These communications 929 typically include commands for operating the motor controller(s) 954 to selectively run motor(s) 956 to operate the puppeteer assembly 950. For example, the motors 956 may move pulleys or other puppet mechanisms (such as levers or rotatable turntables) 958 to operate or animate a marionette 959 suspended from a puppeteer vehicle (not shown) of the assembly 950.

In some embodiments, the show control module 914 is adapted to monitor and/or determine the location of each tender 942 and/or marionette 959. To this end, the system 900 may include one or more positioning camera(s) 996 that transmit position signals/data to system 910 for display 927 on monitor 920 and/or for use in determining the positions. The support membrane may be substantially transparent allowing the cameras 996 to be positioned on the tender side of the membrane or the cameras 996 may be positioned on the puppeteer side of the membrane to determine the position of the marionettes 959. To determine the position of the tenders 942, each tender vehicle may have a unique shape or configuration to allow ready identification. In other cases, an identify symbol or other information may be presented on an outer surface viewable by the camera 996 that can be relayed to the show control system 910 for use in determining the position (e.g., X-Y location on a surface of the membrane) of the tenders 942. In response to the determined positions, the show control module 914 may transmit signals 928, 929 to modify operation of the tenders 942 or marionettes 959 (or to modify show data 932, 934 being transmitted to assist the marionettes 959 in hitting their marks for a show).

The show system 900 further includes one or more smart tenders 960. Such tenders 960 may be configured to move about the show area 940 without requiring positioning signals from the show control system 910 (although they may be provided as supplemental or overriding control over the tenders 960). For example, the tenders 960 may include position sensors 962 such as IR-based sensors that may be processed by direction controls 964 to determine which direction the tender 960 should travel. In one case, the IR-based sensors 962 detect when another tender 942 is in their path, and the direction control 964 acts to operate the motor controllers 966 to cause the motor 968 to drive the wheels 969 to stop and/or turn to avoid a collision. A follower vehicle 970 on an opposite side of the support membrane would passively follow the tender 960 along with its follower object (e.g., an animatronic character/object, a marionette, or another show object) 974.

In other cases, IR transmitters 980 are provided to wash portions of the show area 940 with IR light and the position sensor 962 may detect when the tender is approaching an IR-illuminated object. For example, the IR transmitter 980 may be used to show where a human actor/participant is within the show area 940, and the IR sensor 962 may be aimed into the show area 940 in which the human actor is moving so as to cause the tender 960 to interact with that human (e.g., avoid contact or, in some cases, to position itself and the supported marionette 974 within a predefined distance from the human or other show component).

While the parts used to implement the shown components and their functions may vary, it may be instructive to list components used by the inventors in one prototype or test implementation. The wireless communication modules may include a Bluetooth Modem-BlueSMiRF Gold or similar product(s) from SparkFun Electronics or other distributors, with these devices facilitating serial communications at 9600 to 115000 bps between the computer or control station/system and the target tender vehicle or target puppeteer assembly. The motors may be servo motors such as Pittman® 6217 and/or 9413 motors or other DC brushless servo motors or other design motors. The motor controllers may also vary to practice the invention with Gamoto PID motor controllers (available from Gamatronix) or similar motor controllers designed for use with servo motors being useful in some applications. The batteries may be rechargeable batteries in some settings such as 13.2 V 1100 mAH A123 Racing Batteries (available from A123 Racing) or the like. In some embodiments, the tender vehicles are configured to plug themselves into recharge power sources along the edges of the support membrane or proximate to the show area. The battery of the associated puppeteer may be charged concurrently with the tender vehicle via an induction circuit(s) provided on the paired vehicles. In other cases, the puppeteer vehicle may charge constantly from the tender vehicle, with the tender vehicle periodically recharging its onboard power source (e.g., its rechargeable battery). The software or control application may be in nearly any programming language such as Matlab (available from Mathworks) and may function to talk through control system I/O devices (such as a mouse or joystick) to the motor controllers of the tender vehicle and/or puppeteer vehicle.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. While not shown, additional puppeteers may be provided on a floor or stage or on a sidewall to work in collaboration with a primary or lifting puppeteer. In this embodiment, a lifting or primary puppeteer (supported by a tender riding on a ceiling support membrane) may be used to suspend a marionette and position/move the marionette. Concurrently, a tensioning or secondary puppeteer may be attached to the marionette to pull down (or sideways) on certain limbs or portions of the marionette to achieve a desired effect, such as coordinated lifting and downward (or sideways) pulling to allow the marionette to walk or dance with more authority/weight (e.g., feet of a human character may be caused to firmly contact the stage in contrast to typical puppeted movements).

The above description stresses use of the marionette support and positioning assemblies in the entertainment industry. However, it will be readily understood that the support and positioning techniques described herein may be used with numerous objects other than marionettes and show objects, and these terms are considered to imply a much broader meaning such as animatronic or robotic objects, cameras, lights, and so on. For example, the support and positioning assemblies may be used to move video cameras overhead to film a sporting event or to move lights or speakers in a live theater setting. In industrial applications, the puppeteer assemblies may be used to support and position robots such as in a factory or warehouse to allow the robots to pick and place objects on a factory line or in a warehouse.

We claim:

1. An apparatus for suspending and positioning a show component such as a marionette, comprising:

a support membrane;

a tender vehicle positioned proximate to a first side of the support membrane, the tender vehicle comprising a drive mechanism selectively positioning the tender vehicle relative to the support membrane; and a puppeteer vehicle supporting a show component and positioned proximate to a second side of the support membrane opposite the tender vehicle, wherein at least one of the tender vehicle and the puppeteer vehicle comprises one or more rotatable magnetic elements providing a magnetic field maintaining the puppeteer vehicle proximate to the support membrane, wherein the drive mechanism comprises a pair of magnetic wheels each placed with a peripheral edge in contact with the first side of the support membrane and driven to rotate relative to a body of the tender vehicle on one or more axles supported on the body and wherein the puppeteer vehicle comprises a pair of magnetic wheels mounted for free spinning and each positioned with a peripheral edge in contact with the second side of the support membrane opposite the magnetic wheels of the drive mechanism of the tender vehicle, whereby the puppeteer vehicle passively follows the tender vehicle.

2. The apparatus of claim 1, wherein the support membrane comprises a substantially planar sheet of non-magnetic and at least translucent material with a thickness of less than about 0.25 inches.

3. The apparatus of claim 1, wherein the drive mechanism comprises at least one electric motor rotating the magnetic elements in the tender vehicle.

4. The apparatus of claim 3, the magnetic elements comprising disc-shaped permanent magnets.

5. The apparatus of claim 3, wherein the puppeteer vehicle comprises at least one of the magnetic elements coupled to at least one of the magnetic elements rotated by the electric motor and mounted within the puppeteer vehicle for free spinning.

6. The apparatus of claim 5, wherein the show component comprises a marionette suspended from the puppeteer vehicle and wherein the puppeteer vehicle further includes a drive mechanism for selectively moving at least portions of the suspended marionette.

7. The apparatus of claim 1, wherein the tender vehicle comprises a wireless communication module receiving control signals from a remote control system for operating the drive mechanism to position the tender vehicle.

8. The apparatus of claim 1, wherein the drive mechanism comprises a pair of electric servo motors selectively driving the magnetic wheels to position the tender vehicle.

9. A marionette-based show system, comprising:

a thin, planar support positioned above a stage;

two or more marionette support and positioning assemblies, each of the assemblies comprising:

a tender vehicle positioned on an upper surface of the planar membrane with a rotatable magnetic element abutting the upper surface and a drive mechanism moving the tender vehicle on the upper surface in response to control signals;

a puppeteer vehicle positioned against a lower surface of the planar support with a rotatable magnetic element abutting the lower surface and magnetically coupled to the magnetic element of the tender vehicle; and a show component supported by the puppeteer vehicle; and a show control system in wireless communication with the tender vehicle to transmit the control signals to selectively position the tender vehicle on the planar support.

10. The system of claim 9, wherein the planar membrane comprises a sheet of at least translucent plastic under tension.

11. The system of claim 10, further comprising a camera transmitting images of the marionette and positioning assemblies to the show control system and wherein the show control system modifies the control signals based on locations of at least one of the tender vehicles and the show components determined from the transmitted images.

12. The system of claim 9, wherein one of the support and positioning assemblies is operable to circumnavigate another one of the support and positioning assemblies.

13. The system of claim 9, wherein the show component comprises a marionette suspended from the puppeteer vehicle, the puppeteer vehicle further comprising one or more motorized components for selectively lifting and lowering one or more portions of the marionette.

14. The system of claim 9, wherein the rotatable magnetic element of the tender vehicle comprises a disc-shaped permanent magnet selectively rotated by a servo motor operating in response to the control signals and wherein the rotatable magnetic element of the puppeteer vehicle comprises a disc-shaped permanent magnet mounted for free spinning on the puppeteer vehicle, the disc-shaped permanent magnets being positioned with the planar membrane sandwiched between edges of the disc-shaped permanent magnets and with opposing magnetic poles adjacent to each other.

15. A marionette support apparatus, comprising:

a tender assembly comprising a chassis supporting a pair of motors and a pair of magnetic drive wheels;

a puppeteer assembly comprising a chassis supporting a pair of free spinning magnetic wheels, a marionette suspended from the chassis, and a marionette operating mechanism selectively operable to lift at least a portion of the marionette;

a support membrane comprising a sheet of flexible and at least translucent material under tension, wherein paired ones of the magnetic wheels of the tender assembly and of the puppeteer assembly abut opposite sides of the support membrane, whereby the puppeteer assembly is suspended by the tender assembly; and a show controller transmitting wireless control signals to the tender assembly to selectively operate each of the motors to position the tender assembly in a plurality of positions on the support membrane, wherein the control signals are transmitted in response determination of a relative position of the tender assembly based on light passing through the support membrane.

16. The apparatus of claim 15, wherein the magnetic drive wheels and free spinning magnetic wheels each comprise disc-shaped rare earth permanent magnets and wherein edges of the disc-shaped magnets contact the opposite surfaces of the support membrane.

17. The apparatus of claim 15, wherein the sheet of flexible material comprises a sheet of plastic less than about 30 mils thick and wherein the magnetic drive wheels and the free spinning magnetic wheels comprise disc magnets having a thickness of less than about 0.375 inches and a diameter of less than about 1 inch.

18. The apparatus of claim 15, wherein the marionette comprises an animatronic figure with at least one body portion selectively operable with onboard robotics.

19. The assembly of claim 15, wherein the tender assembly further comprises a sensor assembly detecting an object in a space about the chassis and a direction control module operable to alter a direction of travel for the tender assembly by operation of the motors.

20. An apparatus for suspending and positioning objects, comprising:

a non-magnetic support membrane;

a tender vehicle positioned proximate to a first side of the support membrane, the tender vehicle comprising a drive mechanism selectively positioning the tender vehicle relative to the support membrane; and a vehicle supporting an object and positioned proximate to a second side of the support membrane opposite the tender vehicle, wherein at least one of the tender vehicle and the vehicle comprises one or more rotatable magnetic elements providing a magnetic field maintaining the vehicle proximate to the support membrane, wherein the drive mechanism comprises at least one electric motor rotating the magnetic elements in the tender vehicle and the magnetic elements each comprises a disc-shaped permanent magnet with a peripheral edge abutting the first side of the support membrane such that the peripheral edge rolls upon the first side when the disc-shaped permanent magnet is driven to rotate.

21. The apparatus of claim 20, wherein the support membrane comprises a substantially planar sheet of non-magnetic and at least translucent material with a thickness of less than about 0.25 inches.

22. The apparatus of claim 20, wherein the object comprises at least one of a show component, a marionette, and a robotic mechanism.

23. The apparatus of claim 20, wherein the vehicle comprises at least one of the magnetic elements coupled to at least one of the magnetic elements rotated by the electric motor and mounted within the vehicle for free spinning.

24. The apparatus of claim 20, wherein the vehicle further includes a drive mechanism for selectively moving at least portions of the supported object.

* * * * *